US007905445B2

(12) United States Patent
Kröger

(10) Patent No.: US 7,905,445 B2
(45) Date of Patent: Mar. 15, 2011

(54) UNWINDING DEVICE FOR WINDING DRUM

(75) Inventor: Holger Kröger, Norderstedt (DE)

(73) Assignee: E.C.H. Will GmbH, Hamburg (DE)

( * ) Notice: Subject to any disclaimer, the term of this patent is extended or adjusted under 35 U.S.C. 154(b) by 97 days.

(21) Appl. No.: 12/292,011

(22) Filed: Nov. 10, 2008

(65) Prior Publication Data

US 2009/0134267 A1 May 28, 2009

(30) Foreign Application Priority Data

Nov. 8, 2007 (DE) ..... 10 2007 053 588

(51) Int. Cl.
*B65H 16/06* (2006.01)

(52) U.S. Cl. ..... 242/596.5; 242/598.1

(58) Field of Classification Search ..... 242/598.1, 242/592, 596, 596.1, 596.4, 596.5, 598, 590
See application file for complete search history.

(56) References Cited

U.S. PATENT DOCUMENTS

| | | | | |
|---|---|---|---|---|
| 1,960,452 | A * | 5/1934 | Parsons | 242/559.4 |
| 2,738,935 | A * | 3/1956 | Greene | 242/592 |
| 3,329,369 | A * | 7/1967 | Guthrie | 242/559.3 |
| 3,753,833 | A | 8/1973 | Bassett et al. | |
| 4,895,314 | A | 1/1990 | Thievessen | |
| 4,951,894 | A * | 8/1990 | Young et al. | 242/559.4 |
| 5,333,809 | A * | 8/1994 | Berry et al. | 242/578.1 |
| 6,042,047 | A | 3/2000 | Thievessen | |

FOREIGN PATENT DOCUMENTS

| | | |
|---|---|---|
| DE | 38 25 673 A1 | 2/1990 |
| DE | 42 19 518 A1 | 2/1993 |
| EP | 0 289 749 B1 | 11/1992 |
| EP | 0 909 253 B1 | 11/2001 |
| FR | 71 05004 | 11/1971 |
| GB | 934778 | 8/1963 |

OTHER PUBLICATIONS

European Patent Office (EPO) Office action. dated Aug. 2010 along with an english translation thereof.

* cited by examiner

*Primary Examiner* — Michael R Mansen
*Assistant Examiner* — Juan J Campos
(74) *Attorney, Agent, or Firm* — Greenblum & Bernstein, P.L.C.

(57) ABSTRACT

An unwinding device for wound rolls includes a bearing element, a first support element and a second support element mounted on the bearing element. The first and second support elements are adapted to rotatably hold the wound roll on opposed sides. The first support element and the second support element are movable along the bearing element with respect to one another, such that a distance between the first support element and the second support element changes. The unwinding device also includes a drive mechanism adapted to move the first support element and the second support element along the bearing element. The drive mechanism includes a tensioner movable along the bearing element, and a first engagement member disposed on the first support element. The first engagement member is adapted to releasably lock the first support element to the tensioner.

17 Claims, 1 Drawing Sheet

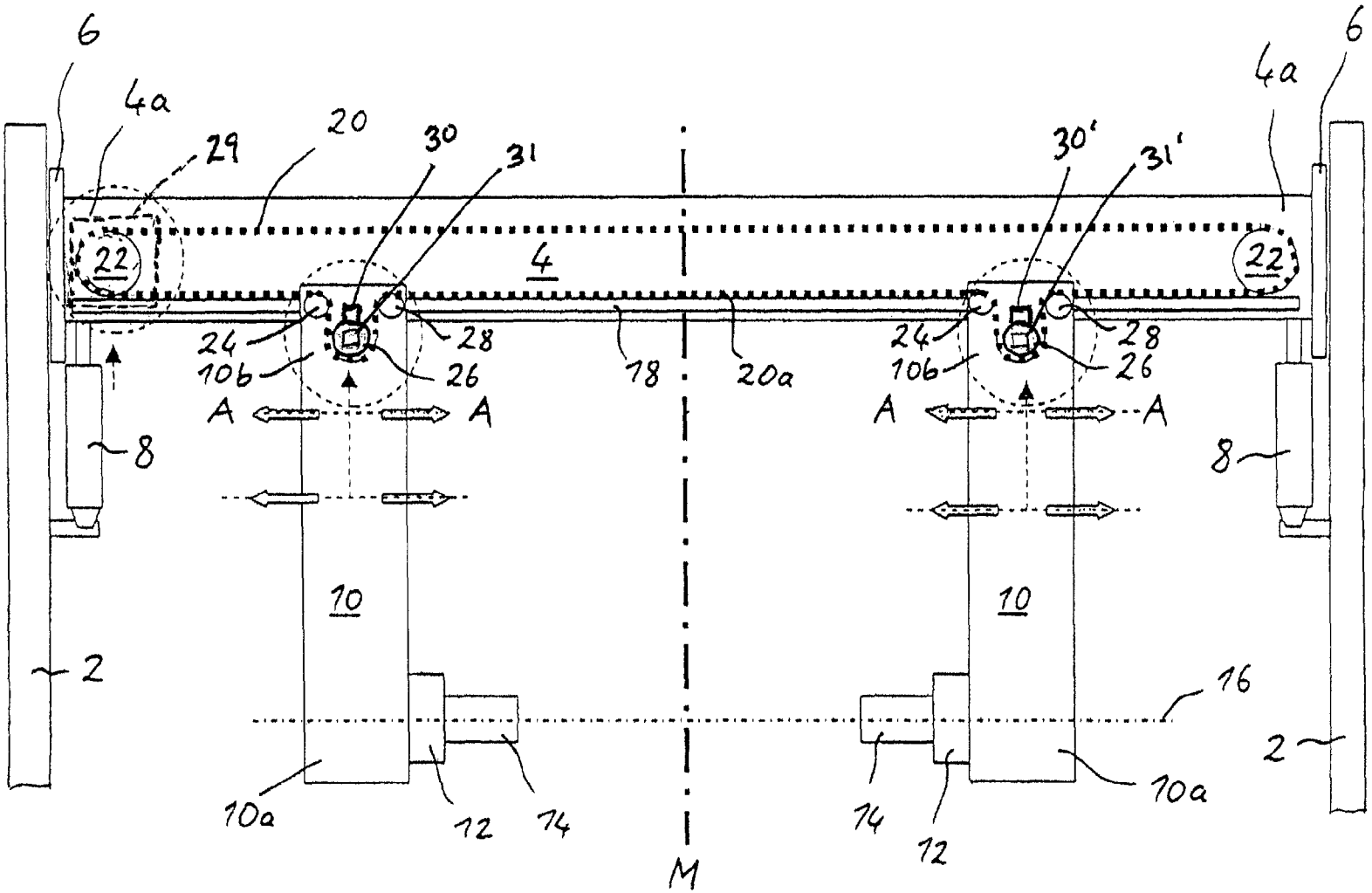
6
4a
22
2
8
16
10a
31'
28
26
A
30'
10
24
10b
12
74
20a
M
78
4
31
30
20
29

UNWINDING DEVICE FOR WINDING DRUM

CROSS-REFERENCE TO RELATED APPLICATION

This application claims the priority of Germany Patent Application No: 10 2007 053 588.2, filed on Nov. 8, 2007, the subject matter of which is incorporated herein by reference.

BACKGROUND

The invention relates to an unwinding device for wound rolls, with a bearing element, two support elements disposed on the bearing element for rotatably holding a wound roll on both sides, and a drive mechanism for moving the two support elements along the bearing element. The two support elements are mounted so that they can move along the bearing element such that, when the two support elements move relative to one another, the spacing between these changes.

Material webs, in particular paper webs in the paper processing industry, are generally delivered and stored in the form of large, heavy wound rolls. When processing material webs of this kind on appropriate machines, these webs are drawn off the wound rolls. These processing machines are therefore provided with appropriate unwinding devices in which the wound rolls are rotatably held on both sides on two support elements disposed on a bearing element. In this case the wound roll is usually clamped without a shaft between the two support elements and held by these during unwinding. The support elements are mounted on the bearing element so that they can move towards and away from one another for loading with a new wound roll, for removing the core of the wound roll following complete unwinding and for setting to different roll widths and adjusting the position in relation to the material web path.

EP 0 909 253 B1 and the corresponding U.S. Pat. No. 6,042,047 A, which constitute the closest prior art on which the present invention is based, disclose an unwinding device for large paper rolls which comprises a frame with four stands and two longitudinal girders, as well as at least one unwinding beam and two support arms each with a clamping head. The support arms are mounted on the unwinding beam so that they can move horizontally and transversely, and are coupled together via a common threaded spindle. A first drive provides for a joint contradirectional transverse displacement of the support arms, and a resultant change in their spacing from one another in order to pick up wound rolls of differing width. A second drive provides for a joint equidirectional transverse displacement of the support arms without changing their spacing from one another, for the relative positioning of the wound roll in the processing machine. Also provided on the frame on both sides for a vertical displacement of the unwinding beam are tension means, preferably in the form of cables, belts or chains, which are fastened to two spindle nuts of a second horizontally disposed threaded spindle, so that the unwinding beam is suspended from the frame via the tension means. This second threaded spindle is rotated by means of a third drive.

EP 0 289 749 B1 and the corresponding U.S. Pat. No. 4,895,314 A disclose a device for unwinding a material web from a roll, in particular a large paper roll for the paper processing industry. In order to rotatably hold a wound roll, this known device also comprises two support arms which are mounted together on a pivot shaft. In order to enable rolls of differing width to be picked up, this known device is also provided with a drive mechanism comprising a threaded spindle by means of which the support arms can be moved in the transverse direction. Also provided is a pivot drive for pivoting the support arms about the pivot shaft, as well as a further drive in order to move the pivot shaft together with the support arms horizontally in the web travel direction. DE 38 25 673 A1 describes a similar unwinding device for large paper rolls which comprises two support arms which are mounted together on a pivot shaft. The support arms are provided with clamping heads which are of a retractable construction in order to be able to pick up new wound rolls.

DE 42 19 518 A1 discloses a device for feeding roll-shaped material to a gluing preparation station. This known device, which is intended in particular for accommodating large paper rolls which are to be unwound, comprises a frame with at least four stands which are connected together by two longitudinal girders. At least one crossmember which can travel in the transverse direction is provided between the longitudinal girders, on which crossmember two support arms are disposed so that they can move horizontally and transversely by means of two trolleys.

The known unwinding devices require in particular a highly complex drive mechanism in order to be able to implement all the desired displacement functions.

SUMMARY

An object of the invention, in a device of the type initially mentioned, is to implement the drive mechanism using a simple design which nevertheless affords all the displacement possibilities.

This object is achieved by an unwinding device for wound rolls with a bearing element, two support elements disposed on the bearing element for rotatably holding a wound roll on both sides, and a drive mechanism for moving the two support elements along the bearing element. The two support elements are mounted so that they can move along the bearing element such that, when the two support elements move relative to one another, the spacing between the support elements changes. The drive mechanism comprises at least one tension means which is mounted so that it can move along the bearing element, and at least one engagement means which is disposed on at least one support element and locks the support element to the tension means in a releasable manner.

The solution according to the invention affords a mechanically simple and inexpensive construction of the drive mechanism, with complete functionality of a so-called pick-up unwinder, which therefore affords all the displacement possibilities. This is achieved according to the invention in that at least one tension means is disposed on the bearing element and is mounted so that it can move along the bearing element, and at least one support element either moves along the tension means or can be disposed so as to be stationary with respect to the latter. For this purpose at least one engagement means is provided on each support element, which means locks the support element to the tension means in a releasable manner. This results in the support element being mechanically anchored to the tension means, which produces a stationary arrangement of the support element on the tension means. Additional safety precautions are not required, as the support elements can only travel together on account of a movement of the tension means along the bearing element and therefore cannot open unintentionally. If, however, the engagement means is released, the associated support element can move with respect to the tension means and along the bearing element and therefore be displaced, the displacement being possible independently of the other support element. The fact that the support elements can only travel together when the tension means moves along the bearing element due to being locked to the tension means results in the further advantage that the spacing between the support elements remains constant during a movement of this kind and therefore a displacement of this kind can also be used to advantage for adjusting the position of the picked-up wound roll in relation to the desired material web path in a machine. The invention accordingly enables both the possibility of setting to different roll widths and adjustment of the position of the picked-up wound roll in a way which is particularly simple in structural terms yet at the same time effective.

The invention essentially requires just simple and inexpensive mechanical elements. When compared with conventional designs, the invention enables a significant cost reduction to be achieved, also in particular in a basic construction in which manual operation is possible in a simple manner and all automation and the cost-intensive assembly and maintenance of electronic components which this entails are eliminated. The design according to the invention nevertheless affords the advantage of upgrading to the point of complete automation. The level of automation which is most frequently required today is constituted by the automatic lateral edge control, whereby the position of the wound roll, already picked up, in relation to the material web path is adjusted, while the accommodation of the wound roll and the setting of the spacing of the support elements from one another, which is required for this, take place manually. Automatic lateral edge regulation of this kind can be adapted with a low expenditure by means of the invention, as just one single drive is required.

Although EP 0 909 253 B1 discloses the use of tension means, these are provided in a way different to that of the invention for a suspended mounting of the unwinding beam on the frame. As opposed to this, in this prior art a threaded spindle is provided for the transverse displacement of the two support arms, which spindle is driven by a motor and has contradirectional pitches in the region of the first support arm mounting and of the second support arm mounting. Individual displacement of the support arms, as is possible with the design according to the invention, is not provided in this prior art and also not even possible on account of the contradirectional pitch of the threaded spindle. This means that this prior art also cannot suggest the invention.

Preferred constructions and developments of the invention are presented in the dependent claims.

The invention can therefore primarily be constructed in two variants, that is in a first variant, in which one of the two support elements is provided with the rotatably mounted engagement means and the other support element is firmly coupled to the tension means, and in an alternative second variant, in which at least one rotatably mounted engagement means is provided on each of the support elements. The last-mentioned second variant permits more flexibility in terms of the setting to different roll widths. Generally speaking, however, all the displacement possibilities can also be implemented with the first-mentioned variant.

A particularly preferred construction of the invention is distinguished by the fact that the engagement means is mounted so as to be rotatable about an axis of rotation which extends at an angle, preferably approximately a right angle, to the direction of movement of the tension means and is in engagement with the tension means such that, upon rotation, the engagement means moves along the tension means and a relative movement of the support element is thereby produced and the support element is locked to the tension means during a standstill. The rotatable mounting of the engagement means accordingly allows the support element to move with respect to the tension means, with the engagement means running along the tension means. If the engagement means is rotated by an external action, whether manually or through a drive, this causes the engagement means to abut against the tension means and therefore the support element to move with respect to the tension means. Through the rotation of the engagement means and the movement, to which this gives rise, of the support element with respect to the tension means, the spacing of this support element from the other support element can be changed and easily set to the width of the wound roll which is to be picked up. In contrast, by bringing the engagement means to a standstill, this, and therefore the support element, is locked to the tension means, which takes place in particular after a wound roll has been picked up. Consequently in this construction the releasable locking is implemented by the engagement means on the one hand either rotating freely or being driven so as to rotate and on the other being held at a standstill for locking.

The tension means is preferably formed as a flexible tension means which in one development of this construction continuously rotates. The tension means can thus not only be formed particularly easily in structural terms, but also disposed in a particularly space-saving manner.

The engagement means can preferably be a pulley, and a portion of the tension means can always be in engagement with at least one portion of the circumference of the pulley. The tension means can wrap around the pulley in portions for particularly effective engagement.

The tension means can be a cable or belt, for example.

However it is alternatively also conceivable for the tension means to be a toothed belt and the engagement means a gear wheel or pinion whose teeth engage in the spaces between the teeth of the toothed belt.

As a further alternative, it is conceivable for the tension means to be a chain and the engagement means a gear wheel or pinion whose teeth engage in the chain links of the chain.

The tension means should expediently be mounted so that it can move at least in portions along a substantially straight line. As the two support elements are usually provided to rotatably hold a wound roll on both sides about its axis of rotation, that substantially straight line along which the tension means can move at least in portions should expediently be directed approximately parallel to that axis of rotation.

It is of advantage, in particular for a remote-controlled or automated operation, for the drive mechanism to comprise at least one drive disposed on the bearing element for a driven movement of the tension means along the bearing element. The drive mechanism can alternatively or additionally comprise, for a driven rotation of at least one engagement means, at least one drive which is disposed on the associated support element and which, in one embodiment of this construction, comprises a brake in order to be able to hold the engagement means at a standstill if required. Electric motors are expediently used as drives of this kind.

The support elements preferably each comprise a pivot pin for rotatably mounting a wound roll, the pivot pins being directed towards one another with their free ends and being disposed coaxially with one another. In one development of this construction the pivot pins are formed for insertion or introduction into a core or a sleeve of a wound roll. The pivot pins are therefore guide heads or can be part of guide heads formed on the free end of the support elements.

The support elements are expediently formed as support arms which are usually suspended from the bearing element. The support arms can in each case be provided at their free end with a bearing means for rotatably mounting one side of a wound roll, which bearing means is usually the above-mentioned pivot pin. It is to be observed at this point, for the sake of completeness, that the wound roll may be held on the support elements so as to be optionally releasable not just on account of the spacing-variable displacement of the support elements, but also due to additional structural measures in order to be able to easily exchange the wound rolls.

The bearing element is preferably formed as a crossmember which is disposed substantially horizontally.

Furthermore, a frame on which the bearing element is disposed is preferably provided. In one expedient embodiment of this construction the bearing element is disposed on the frame so as to be vertically displaceable, for which purpose a lifting drive mechanism can preferably be provided. A hydraulic or pneumatic piston-cylinder arrangement, for example, can be used as the lifting drive mechanism. In this construction the wound roll which is held by the support elements can therefore be displaced not just in the axial direction, which usually corresponds approximately with the horizontal, but additionally also in the vertical direction.

BRIEF DESCRIPTION OF THE DRAWINGS

A preferred embodiment of the invention is illustrated in detail in the following on the basis of the accompanying FIGURE, in which a preferred construction of the unwinding device according to the invention is shown schematically.

DETAILED DESCRIPTION

The preferred construction represented schematically in the accompanying FIGURE of an unwinding device for wound rolls which is primarily used in the paper-processing industry in order to draw paper webs for further processing of a wound roll comprises a frame, of which only two spaced, vertical stands 2 are shown schematically in portions in the accompanying FIGURE. Four vertical stands of this kind which are connected together by way of longitudinal and cross girders, which are likewise not represented in the FIGURES, are usually provided to form the frame.

As shown by the FIGURE, a crossmember 4, which extends approximately horizontally, is disposed between two spaced vertical stands 2. In the represented embodiment the crossmember 4 is mounted with its two lateral ends 4*a* on the respective stands 2 so that it can move in the vertical direction, the mounting being formed in the represented embodiment by a rail guide system which acts in the vertical direction and is represented schematically and marked with the reference character 6 in the FIGURE. In the represented embodiment pneumatic or hydraulic piston-cylinder arrangements 8 are provided as drives for the vertical height adjustment, these being supported with one of their ends, preferably the cylinder, on the associated stand 2 and acting with their other end, preferably the end of the piston rod, on the corresponding end 4*a* of the crossmember 4.

As the FIGURE also shows, two support arms 10 are suspended from the crossmember 4 in the represented embodiment. The support arms 10 serve to hold a wound roll, which is not represented in the FIGURE, in a releasable manner. For this purpose each support arm 10 is provided at its bottom free end 10*a* with a guide head 12 comprising a pivot pin 14. The guide heads 12 serve to engage in a releasable manner with a sleeve or a core of a wound roll which is to be picked up through the introduction or insertion of the pivot pins 14 into the open side of the sleeve or the core of the wound roll which is to be picked up. In order to hold the wound roll, the two support arms 10 therefore take up the wound roll between them and hold the wound roll at its two sides. At the same time the pivot pins 14 ensure that the wound roll is rotatably mounted about an axis 16, for which purpose the pivot pin 14 or even the entire guide head 12 can also be accordingly rotatably mounted on the respective support arm 10. As the wound roll is picked up between the support arms 10, the guide heads 12 are directed with their pivot pins 14 towards one another and disposed coaxially with one another due to their axes of rotation lying together on the common axis 16 which, when a wound roll is held, substantially coincides with the axis of rotation thereof.

For removing the core of the wound roll following complete unwinding, for subsequently loading the device with a new wound roll and for setting to the width of the wound roll which is used, the spacing between the two support arms 10 must be variable in order to release the pivot pins 14 from the core of the used wound roll and to place a new wound roll between the support arms 10 without obstruction. The support arms 10 are therefore mounted on the crossmember 4 so as to be displaceable transversely. For this purpose the crossmember 4 is provided with a guide rail system which is represented schematically and marked with the reference character 18 in the FIGURE. The support arms 10 are mounted in a suspended fashion with their top end 10*b*, which is adjacent to the crossmember 4, at this guide rail system 18, which includes a drive 29 on crossmember 4, the support arms 10 are movable in the direction of the arrows A represented in the FIGURE and therefore horizontally and transversely to their longitudinal extent along the crossmember 4.

The length of the crossmember 4 and the resultant spacing of the two stands 2 is determined by the desired maximum width of the wound roll which is to be used, also called the working width.

Whereas for loading with a new wound roll and removing the core of a used wound roll the spacing between the support arms 10 must be changed accordingly, a change in the spacing between the support arms 10 is not desired when the wound roll is held on the support arms. Simply for reasons of safety it should not be possible to open the support arms 10 unintentionally. Moreover, in order to adjust the position in relation to a desired material web path for further processing of the material which is to be drawn off the wound roll, it must be possible to displace the wound roll in the axial direction when this is already held on the support arms 10. A special drive mechanism, which is illustrated in detail in the following, is required to enable these various displacement possibilities to be implemented.

In the represented embodiment one component part of this mechanism is formed by a chain 20 which is mounted so as to circulate continuously on the crossmember 4. As shown by the FIGURE, in which the chain 20 is represented schematically as a dotted line, the chain 20 extends with its two halves in the longitudinal direction of the crossmember 4. An appropriate return pulley 22 is rotatably mounted at each end 4*a* of the crossmember 4 in order to deflect the continuously circulating chain 20. In the represented embodiment the bottom half 20*a*, adjacent to the support arms 10, of the chain 20 is deflected in the region of the adjacent end 10*b* of both support arms 10 about a first pulley 24, which is rotatably mounted at each end 10*b* of the support arms 10, from a substantially horizontal direction through approximately 90° downwards into a substantially vertical direction onto a gear wheel or pinion 26, which is likewise rotatably mounted at each end 10*b* of the support arms 10. The teeth, which cannot be distinguished in the FIGURE, of the pinion 26 engage in the chain links, which likewise cannot be distinguished in detail, of the chain 10, whereby the pinion 26 is in each case in engagement with a portion of the bottom half 20*a* of the chain 20. In the represented embodiment the bottom half 20*a* of the chain 20 wraps around the pinion 26 through approximately 180° and then runs approximately in the vertical direction to a second pulley 28, which is likewise rotatably mounted at each end 10*b* of the support arms 10, where the half 20*a* is again deflected into an approximately horizontal direction and leaves the support arms 10. As the FIGURE also shows, the first and second pulleys 24, 28 lie approximately at the same height in relation to the crossmember 4 and, according to the representation of the FIGURE, approximately at the same vertical height, whereas in the represented embodiment the pinion 26 lies below these two pulleys 24, 28, so that the above-mentioned wrap of the bottom half 20*a* of the chain 20 through approximately 180° can be achieved. The axes of rotation of the pulleys 24, 28 and of the pinion 26 extend parallel to one another and in the represented embodiment are directed at a right angle to the axis 16 or the direction of movement A of the support arms 10.

Furthermore, an immobilising mechanism 30 is provided in the region of the top end 10*b* of the support arms 10 in order to enable the pinion 26 to be retained at a standstill. This immobilising mechanism 30 is preferably constructed as a brake. The respective support arm 10 is locked to the chain 20 by retaining the pinion 26 at a standstill. As a result, a transverse displacement of the respective support arm 10 is only possible by moving the chain 20 in its longitudinal direction, while the respective support arm 10 remains stationary with respect to the chain 20.

The locking described above by means of the immobilising mechanisms or brakes 30, 30' is of particular advantage when the two support arms 10 are locked to the chain 20. For this results in the spacing between the two support arms 10 also remaining constant when the chain 20 is displaced, which leads to a common transverse displacement of the overall arrangement of the two support arms 10. No additional safety precautions are required.

The simultaneous locking of the two support arms 10 is in particular of importance for automatic lateral edge control, whereby the position of the wound roll, already held on the support arms 10, in relation to a defined material web path is adjusted for further processing of the material drawn off the wound roll, the centre axis of a material web path of this kind being marked schematically in the FIGURE as a dash-dot line M. A drive must be provided for the chain 20 for automatic lateral edge control of this kind. An electric motor is preferably used for this purpose, this driving one of the two return pulleys 22 and being mounted on the crossmember 4. A drive of this kind is not represented in the FIGURE.

It is sufficient, in particular for automatic lateral edge control, for the immobilising mechanisms or brakes 30, 30' to be constructed so that they can only be operated manually. The immobilising mechanism or brake 30, 30' must be released manually at least at one support arm 10 for loading and unloading in order to increase the spacing between the two support arms 10 for removing the used wound roll and accommodating a new wound roll before the pivot pins 14 of the guide heads 12 are introduced into the two open sides of the new wound roll, while reducing the spacing between the two support arms 10. For this operation the immobilising mechanisms or brakes 30, 30' should preferably be released at both support arms 10. After the new wound roll has been picked up, the immobilising mechanisms or brakes 30, 30' are activated again in order to prevent the support arms 10 from being unintentionally opened.

During loading and unloading the crossmember 10 can be adjusted in height by means of the lifting drive mechanism 8 described above. Of course the lifting drive mechanism 8 can also be used while the operation is running in order that the position of the held wound roll in the vertical direction in relation to the material web path can be adjusted.

It becomes clear from the above statements that, with the immobilising mechanisms or brakes 30, 30' released or deactivated, the two support arms 10 can be displaced independently of one another in the transverse direction according to the arrow A.

For a fully automatic construction it is conceivable to provide each of the two pinions 26 with their own drive 31, 31', which is mounted on the respective support arm 10. An electric motor which drives the shaft of the respective pinion 26 should preferably also be provided in this connection. The drives 31, 31' of the pinions 26 at the two support arms 10 are to be activated independently of one another for independent displacement.

Finally, it should also be pointed out that a toothed belt, for example, can also be used instead of a chain 20, in which case the teeth of the pinions 26 engage in the spaces between the teeth of the toothed belt.

However it is alternatively also conceivable to provide a toothless belt instead of the chain 20 and pulleys instead of the pinions 26, in which case, however, measures must be taken to ensure that the friction between the belt and the pulleys to be used instead of the pinions 26 is great enough to prevent slippage from occurring.

In this connection it is also pointed out that, instead of a continuously circulating tension means, which in the embodiment described previously is formed as a chain 20, the tension means preferably formed as a chain or a belt can alternatively also be of a finite length, i.e. be finite and fastened with each of its ends to one of the two return pulleys 22, so that an arrangement of this kind operates according to the cable winch principle.

Further advantageous arrangements can also be implemented as alternatives to the suspended arrangement described above of the support arms 10. For example, a stationary arrangement of the support arms 10 is alternatively conceivable, in which case the crossmember 4 could preferably be disposed under the floor in order to provide a frameless arrangement. In the case of a stationary arrangement of the support elements 10 it is also conceivable to mount the crossmember 4 pivotably on the floor in order to be able to pivot the entire device between a roll take-up position and a working or unwinding position, for example. Finally, however, the support arms 10 can alternatively also be oriented horizontally, in which case the crossmember 4 can either be movable vertically and/or horizontally or mounted in a fixed manner.

The invention claimed is:

1. An unwinding device for wound rolls, comprising:

a bearing element;

a first support element and a second support element mounted on the bearing element, the first and second support elements adapted to rotatably hold the wound roll on opposed sides, wherein the first support element and the second support element are movable along the bearing element with respect to one another; and a drive mechanism adapted to move the first support element and the second support element along the bearing element, the drive mechanism comprising:

a single one of a chain or toothed belt movable along the bearing element; and a first engagement member disposed on the first support element, wherein the first engagement member is adapted to releasably lock the first support element to the chain or toothed belt, and is rotatable about an axis crosswise to a direction of movement of the chain or toothed belt;

the first engagement member engages the chain or toothed belt such that, upon rotation of the first engagement member, the first engagement member moves along the chain or toothed belt, thereby producing a relative movement of the first support element with respect to the chain or toothed belt; and the first support element is locked to the chain or toothed belt when the first engagement member is locked still, wherein the drive mechanism comprises a drive disposed on the bearing element that is adapted to move the chain or toothed belt along the bearing element, and drives for each of the first and second support elements that are adapted to rotate a respective engagement member, wherein each of the drives for the first and second support elements comprise a brake adapted to hold the respective engagement member at a standstill.

2. The unwinding device of claim 1, wherein the second support element is fixed into position on the single one of a chain or toothed belt.

3. The unwinding device of claim 1, further comprising a second engagement member disposed on the second support element.

4. The unwinding device of claim 1, wherein the first engagement member comprises a pulley defining a circumference, and a portion of the single one of a chain or toothed belt is always in engagement with at least a portion of the circumference of the pulley.

5. The unwinding device of claim 4, wherein the single one of a chain or toothed belt wraps around the pulley in portions.

6. The unwinding device of claim 1, wherein the single one of a chain or toothed belt comprises a toothed belt having first teeth, and the first engagement member comprises a gear wheel or pinion having second teeth, wherein the second teeth engage in spaces between the first teeth.

7. The unwinding device of claim 1, wherein the single one of a chain or toothed belt comprises a chain having links, and the first engagement member comprises a gear wheel or pinion having teeth that engage in the links of the chain.

8. The unwinding device of claim 1, wherein the single one of a chain or toothed belt is movable along a substantially straight line.

9. The unwinding device of claim 8, wherein the first support element and the second support element are adapted to hold the wound roll on opposed sides such that the wound roll is rotatable about an axis of rotation that is approximately parallel to the substantially straight line.

10. The unwinding device of claim 1, wherein the first support element comprises a first pivot pin having a first free end and the second support element comprises a second pivot pin having a second free end, the first and second support elements adapted to rotatably mount the wound roll, wherein the first and second pivot pins are directed towards one another with the first and second free ends oriented coaxially with one another.

11. The unwinding device of claim 1, wherein the first support element comprises a first support arm, and the second support element comprises a second support arm.

12. The unwinding device of claim 11, wherein the first support arm comprises a free end having a first bearing adapted to connect to a first side of the wound roll, and the second support arm comprises a second free end having a second bearing adapted to connect to a second side of the wound roll.

13. The unwinding device of claim 12, wherein the first bearing comprises a first pivot pin, and the second bearing comprises a second pivot pin.

14. The unwinding device of claim 1, wherein the bearing element comprises a crossmember.

15. The unwinding device of claim 1, further comprising a frame on which the bearing element is disposed.

16. The unwinding device of claim 15, wherein the bearing element is vertically displaceable on the frame.

17. The unwinding device of claim 16, further comprising a lifting drive mechanism adapted to move the bearing element vertically.

* * * * *